US012108793B2

(12) United States Patent
Nicolas

(10) Patent No.: US 12,108,793 B2
(45) Date of Patent: Oct. 8, 2024

(54) SHISHA CARTRIDGE FOR HOUSING AN AEROSOL-FORMING SHISHA SUBSTRATE

(71) Applicant: PHILIP MORRIS PRODUCTS S.A., Neuchâtel (CH)

(72) Inventor: Frederic Nicolas, Moret-Loing-et-Orvanne (FR)

(73) Assignee: PHILIP MORRIS PRODUCTS S.A., Neuchâtel (CH)

( * ) Notice: Subject to any disclaimer, the term of this patent is extended or adjusted under 35 U.S.C. 154(b) by 386 days.

(21) Appl. No.: 17/616,504

(22) PCT Filed: Jun. 24, 2020

(86) PCT No.: PCT/IB2020/055980
§ 371 (c)(1),
(2) Date: Dec. 3, 2021

(87) PCT Pub. No.: WO2020/261147
PCT Pub. Date: Dec. 30, 2020

(65) Prior Publication Data

US 2022/0218027 A1 Jul. 14, 2022

(30) Foreign Application Priority Data

Jun. 26, 2019 (EP) ..... 19182684

(51) Int. Cl.
*A24F 40/42* (2020.01)
*A24D 1/14* (2006.01)
(Continued)

(52) U.S. Cl.
CPC ..... *A24F 40/42* (2020.01); *A24D 1/14* (2013.01); *A24F 1/30* (2013.01); *A24F 40/20* (2020.01); *A24F 40/485* (2020.01)

(58) Field of Classification Search
CPC ..... A24F 40/42; A24F 40/485; A24F 40/20; A24F 1/02; A24F 1/24; A24D 1/14
See application file for complete search history.

(56) References Cited

U.S. PATENT DOCUMENTS 11,564,412 B2 * 1/2023 Fernando ..... A24F 1/30
11,602,163 B2 * 3/2023 Gonzalez Florez ..... A24F 1/30
(Continued)

FOREIGN PATENT DOCUMENTS

CN 108201171 A 6/2018
EP 2485627 9/2013
(Continued)

OTHER PUBLICATIONS

International Preliminary Report on Patentability for PCT/IB2020/055980, issued Jan. 6, 2022; 9 pages.
(Continued)

*Primary Examiner* — Harshad C Patel
(74) *Attorney, Agent, or Firm* — Mueting Raasch Group

(57) ABSTRACT

A cartridge for housing an aerosol-forming substrate includes a body comprising a side wall and a bottom wall; and a cavity inside the body. One or more of the walls include a heat-deformable portion constructed to form an aperture in response to exposure above a threshold temperature, wherein the cavity is in fluid communication with an outside of the cartridge body via the formed aperture.

15 Claims, 6 Drawing Sheets

(51) Int. Cl.

| | |
|---|---|
| ***A24F 1/30*** | (2006.01) |
| ***A24F 40/20*** | (2020.01) |
| ***A24F 40/485*** | (2020.01) |

(56) References Cited

U.S. PATENT DOCUMENTS

| | | | | |
|---|---|---|---|---|
| 11,800,894 | B2 * | 10/2023 | Fernando | A24F 5/04 |
| 2011/0186060 | A1 | 8/2011 | Saleh | |
| 2011/0271844 | A1 | 11/2011 | Mariller et al. | |
| 2012/0298107 | A1 | 11/2012 | Houzego et al. | |
| 2014/0069446 | A1 | 3/2014 | Haddad | |
| 2016/0309789 | A1 | 10/2016 | Thomas, Jr. | |
| 2020/0329760 | A1 * | 10/2020 | Gonzalez Florez | A24F 40/42 |
| 2022/0264949 | A1 * | 8/2022 | Graf | A24F 40/20 |

FOREIGN PATENT DOCUMENTS

| | | | |
|---|---|---|---|
| EP | 2671911 | | 10/2016 |
| RU | 2430664 | C2 | 10/2011 |
| WO | WO 2015/172224 | A1 | 11/2015 |
| WO | WO 2016/001926 | A1 | 1/2016 |
| WO | WO 2016/082851 | A1 | 6/2016 |
| WO | 2017122196 | | 7/2017 |
| WO | 2017178931 | | 10/2017 |
| WO | 2017207416 | | 12/2017 |
| WO | 2019069160 | | 4/2019 |

OTHER PUBLICATIONS

United Arab Emirates Office action for UAE Application No. P6002382/21 issued by the UAE Patent Office on Oct. 30, 2023; 8 pgs.

European Search Report for EP 19182684.1 issued by the European Patent Office on Dec. 20, 2019; 8 pgs.

International Search Report and Written Opinion for PCT/IB2020/055980 issued by the European Patent Office on Sep. 17, 2020; 10 pgs.

Tai et al., "Control of Pore Size and Structure of Tissue Engineering Scaffolds Produced by Supercritical Fluid Processing," European Cells and Materials, 2007;14:67-77.

Russian Office Action for RU Application No. 2022101536, issued by the Patent Office of the Russian Federation on Oct. 10, 2023; 19 pgs. Including English translation.

Japanese Office Action for JP 2021-575383 issued by the Japanese Patent Office on Jun. 17, 2024; 8 pgs. including English Translation.

* cited by examiner

SHISHA CARTRIDGE FOR HOUSING AN AEROSOL-FORMING SHISHA SUBSTRATE

This application is the § 371 U.S. National Stage of International Application No. PCT/IB2020/055980, filed 24 Jun. 2020, which claims the benefit of European Application No. 19182684.1, filed 26 Jun. 2019, the disclosures of which are incorporated herein by reference.

This disclosure relates to aerosol-generating devices and to cartridges containing an aerosol-forming substrate for use in aerosol-generating devices. Embodiments of the present disclosure relate to shisha devices and to cartridges comprising an aerosol-forming substrate for use in shisha devices.

Traditional shisha devices are used to smoke tobacco and are configured such that vapor and smoke pass through a water basin before inhalation by a consumer. Shisha devices may include one outlet, or more than one outlet so that the device may be used by more than one consumer at a time. Use of shisha devices is considered by some to be a leisure activity and a social experience.

Typically, traditional shishas are used in combination with a substrate, sometimes referred to in that art as hookah tobacco, tobacco molasses, or simply as molasses. Traditional shisha substrates are relatively high in sugar (in some cases, up to ~50% vs. the ~20% typically found in conventional tobacco substrates, such as in combustible cigarettes). The tobacco used in shisha devices may be mixed with other ingredients to, for example, increase the volume of the vapor and smoke produced, to alter flavor, or both.

Traditional shisha devices employ charcoal, such as charcoal pellets to heat and sometimes combust the tobacco substrate to generate an aerosol for inhalation by a user. Using charcoal to heat the tobacco may cause full or partial combustion of the tobacco or other ingredients. Additionally, charcoal may generate harmful or potentially harmful products, such as carbon monoxide, which may mix with the shisha vapor and pass through the water basin to the outlet.

One way to reduce the production of carbon monoxide and combustion by-products is to employ e-liquids rather than tobacco. Shisha devices that employ e-liquids eliminate combustion by-products but deprive shisha consumers of the traditional tobacco-based experience.

Other shisha devices have been proposed that employ electric heaters to heat, but not combust, tobacco. Such electrically heated heat-not-burn shisha devices heat the tobacco substrate to a temperature sufficient to produce an aerosol from the substrate without combusting the substrate, and therefore reduce or eliminate by-products associated with combustion of tobacco.

Shisha devices may employ a cartridge for housing an aerosol-forming substrate. The cartridge may be filled with such aerosol-forming substrate. The aerosol-forming substrate may comprise tobacco, preferably shisha substrate, such as molasses—a mixture of tobacco, water, sugar, and other components, such as glycerine, flavors, etc. The heating system of the electrically heated shisha device heats the contents of the cartridge to generate aerosol, which is conveyed through an airflow path to a user.

In order to facilitate airflow through the cartridge and the flow of the aerosol from the cartridge, a shisha cartridge may have one or more holes through one or more walls. The cartridge may include one or more holes at the top, one or more holes at the bottom, or both one or more holes at the top and one or more holes at the bottom. The holes may also be disposed along the sides of the cartridge.

The holes or openings in the cartridge, if left unsealed, may lead to loss of freshness (for example, moisture content) or contamination of the substrate, as well as issues with leakage. For one or more reasons, such as in order to maintain freshness, to prevent leakage of the substrate, or to preserve the quality and integrity of the substrate during storage, it is desirable to close or seal the openings or holes of the cartridge prior to use or between uses if the entire contents of the cartridge are not used at once.

It would be desirable to provide a shisha cartridge where openings are automatically formed by heating the cartridge. It would be desirable to provide a shisha cartridge that does not require a peelable sticker or liner to seal the openings. It would be desirable to provide a shisha cartridge that before exposure to a temperature at or above a threshold temperature is closed and after exposure to a temperature at or above the threshold temperature has openings.

According to embodiments of the present invention, there is provided a cartridge for housing an aerosol-forming substrate. The cartridge may comprise a body. The body may comprise a side wall and a bottom wall. The cartridge may comprise a cavity inside the body. The cavity may be for receiving the aerosol-forming substrate. One or more of the walls of the body may comprise a heat deformable portion. The heat deformable portion may be configured to form an aperture in response to exposure of the heat-deformable portion to a temperature above a threshold temperature. The cavity may be in fluid communication with an outside of the cartridge body via the formed aperture. Advantageously, an airflow path between the cavity and the formed aperture may be provided upon heating of the cartridge. In some embodiments, the aerosol-forming substrate comprises tobacco. In some embodiments, the cartridge is a shisha cartridge and the aerosol-forming substrate comprises a shisha substrate, such as hookah tobacco. In some embodiments, one or more additional openings are provided in the body of the cartridge, as will later be described. Advantageously this provides an airflow path through the cartridge.

According to embodiments of the present invention, there is provided a cartridge for housing an aerosol-forming substrate. The cartridge comprises a body. The body comprises at least a side wall and a bottom wall. The cartridge comprises a cavity inside the body, the cavity for receiving the aerosol-forming substrate. One or more of the walls of the body comprise a heat deformable portion. The heat deformable portion is configured to form an aperture in response to exposure of the heat-deformable portion to a temperature above a threshold temperature. The cavity is in fluid communication with an outside of the cartridge body via the formed aperture. Advantageously, an airflow path between the cavity and the formed aperture is provided upon heating of the cartridge. In some embodiments, the aerosol-forming substrate comprises tobacco. In some embodiments, the cartridge is a shisha cartridge and the aerosol-forming substrate comprises a shisha substrate, such as hookah tobacco. In some embodiments, one or more additional openings are provided in the body of the cartridge, as will later be described. Advantageously this provides an airflow path through the cartridge.

Various embodiments of the present disclosure relate to a cartridge that includes a heat-deformable portion. When the heat-deformable portion is heated, apertures are exposed or are formed in the heat-deformable portion. In some embodiments, the heat-deformable portion may be heated during operation of an aerosol-generating device. In some embodiments, operation of the aerosol-generating device comprises a pre-heat operation mode of the aerosol-generating device.

Some embodiments of the present disclosure relate to a shisha cartridge. In some embodiments, the cartridge is a shisha cartridge that includes a heat-deformable portion. When the heat deformable portion is heated, apertures are exposed or are formed in the heat-deformable portion. In some embodiments, the heat-deformable portion may be heated during operation of an aerosol-generating device. In some embodiments, the aerosol-generating device is a shisha device. In some embodiments, operation of the aerosol-generating device comprises a pre-heat operation mode of the aerosol-generating device.

The cartridge may be closed prior to use. The cartridge may be closed prior to use without a removable closing element. In some embodiments, the cartridge may be sealed prior to use. In some embodiments, the cartridge may be sealed prior to use without a removable sealing element. For example, the cartridge may be closed or sealed prior to use without a removable layer, such as a film, sticker, or liner. According to some embodiments, the cartridge does not require a peelable seal, film, or sticker. The apertures in the cartridge are exposed or formed by heating the cartridge. Advantageously, no additional action by a user is required to form or open the apertures. A user of the cartridge may simply place the cartridge in the aerosol-generating device without first needing to remove a seal, film, or sticker. In certain other embodiments, a removable (for example peelable) seal, film, or sticker is included to provide additional protection against leaks.

According to some embodiments of the present disclosure, the heat-deformable portion has a threshold temperature. One or more apertures may form or be exposed in the one or more walls of the cartridge when the cartridge is heated above the threshold temperature. In some embodiments, the threshold temperature is a temperature that is at the operating temperature of the aerosol-generating device. Advantageously, the apertures are formed or exposed by the heating of the cartridge in the aerosol-generating device.

The heat-deformable portion may comprise a heat-deformable material. The heat-deformable material may comprise a polymer film. The heat-deformable portion may comprise any one of or combination of: a relatively thinner portion of the heat-deformable material; a laminate of heat-deformable material and non-heat-deformable material, where the non-heat-deformable material comprises apertures covered or sealed by the heat-deformable material; one or more cuts or perforations in the heat-deformable material; gas pockets in the heat-deformable material; heat deformable material that changes shape (for example, curls, bends, contracts); and heat-deformable material that is a shape-memory material that changes shape (for example, curls) above the threshold temperature.

In some embodiments, the heat-deformable portion comprising shape-memory material may be reversible. For example, once the cartridge cools down to below a recovery temperature, the shape-memory material may assume its initial shape, causing the apertures to close. The recovery temperature may be the same as the threshold temperature. In some embodiments, the recovery temperature is lower than the threshold temperature. In some embodiments, the recovery temperature is higher than the threshold temperature.

The term "aerosol" is used herein to refer to a suspension of fine solid particles or liquid droplets in a gas, such as air, which may contain volatile flavor compounds.

The term "aerosol-forming substrate" is used herein to refer to a material to be heated to volatilize one or more components of the aerosol-forming substrate to generate an aerosol. The aerosol-forming substrate may be disposed inside the cartridge.

The terms "integral" and "integrally formed" are used herein to describe elements that are formed in one piece (a single, unitary piece) and cannot be separably removed from each other without causing structural damage to the piece.

The term "heat-deformable" is used here to refer to a material that deforms (for example, changes shape) at or above a threshold temperature. For example, in some embodiments, the heat-deformable material may shrink, contract, rupture, break, bend or curl when heated to the threshold temperature.

The term "shape-memory material" is used herein to refer to a material that changes shape at or above a threshold temperature (for example, a first threshold temperature) and returns substantially to its original shape at or below a second threshold temperature (for example, a recovery temperature). In some embodiments, the second threshold temperature may be lower than the first threshold temperature.

As used herein, the singular forms "a," "an," and "the" also encompass embodiments having plural referents, unless the content clearly dictates otherwise.

As used herein, "or" is generally employed in its sense including "one or the other or both" unless the content clearly dictates otherwise.

The term "about" is used herein in conjunction with numeric values to include normal variations in measurements as expected by persons skilled in the art, and is understood to have the same meaning as "approximately." The term "about" understood to cover a typical margin of error. A typical margin of error may be, for example, ±5% of the stated value.

As used herein, "have," "having," "include," "including," "comprise," "comprising" or the like are used in their open-ended sense, and generally mean "including, but not limited to". It will be understood that "consisting essentially of," "consisting of," and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

The term "substantially" as used herein has the same meaning as "significantly," and can be understood to modify the term that follows by at least about 90%, at least about 95%, or at least about 98%. The term "not substantially" as used herein has the same meaning as "not significantly," and can be understood to have the inverse meaning of "substantially," i.e., modifying the term that follows by not more than 10%, not more than 5%, or not more than 2%.

Any direction referred to herein, such as "top," "bottom," "left," "right," "upper," "lower," and other directions or orientations are described herein for clarity and brevity are not intended to be limiting of an actual device or system. Devices and systems described herein may be used in a number of directions and orientations.

The cartridges of the present disclosure may comprise any suitable body defining a cavity. Aerosol-forming substrate may be disposed in the cavity of the cartridge. The body is preferably formed from one or more heat-resistant materials, such as a heat-resistant metal or polymer. The body may comprise a thermally conductive material. For example, the body may comprise any of aluminum, copper, zinc, nickel, silver, any alloys thereof, and combinations thereof. Preferably, the body comprises aluminum. In some embodiments, the body includes a laminated material.

According to an embodiment, at least one of the walls of the cartridge body includes a heat-deformable portion that forms an aperture (for example, one or more holes) when heated to a temperature at or above the threshold temperature.

The cartridge may be of any suitable shape. For example, the cartridge may have a shape configured to be received by a shisha device. The cartridge may have a substantially cuboidal shape, cylindrical shape, frustoconical shape, or any other suitable shape. Preferably, the cartridge has a generally cylindrical shape or a frustoconical shape.

The aerosol-generating device may be a shisha device. The aerosol-generating device is configured to heat the aerosol-forming substrate in the cartridge. The device may be configured to heat the aerosol-forming substrate in the cartridge by conduction. The cartridge is preferably shaped and sized to allow contact with, or minimize distance from, a heating element of the shisha device to provide efficient heat transfer from the heating element to the aerosol-forming substrate in the cartridge. The heat may be generated by any suitable mechanism, such as by resistive heating or by induction or by a combination of resistive heating and induction heating. In order to facilitate inductive heating, the cartridge may be provided with a susceptor. For example, the cartridge body may be made from or include a material (for example, aluminum) that is capable of acting as a susceptor, or a susceptor material may be provided within the cavity of the cartridge. A susceptor material may be provided within the cavity of the cartridge in any form, for example a powder, a solid block, shreds, etc.

Any suitable aerosol-forming substrate may be provided in the cavity defined by the body of the cartridge. The aerosol-forming substrate is preferably a substrate capable of releasing volatile compounds. The aerosol-forming substrate is preferably a substrate capable of releasing compounds that may form an aerosol. The volatile compounds may be released by heating the aerosol-forming substrate. The aerosol-forming substrate may be solid or liquid or comprise both solid and liquid components. Preferably, the aerosol-forming substrate is a shisha substrate. A shisha substrate is understood to mean a consumable material that is suitable for use in a shisha device. Shisha substrate may include molasses.

The aerosol-forming substrate may include nicotine. The nicotine containing aerosol-forming substrate may include a nicotine salt matrix. The aerosol-forming substrate may include plant-based material. The aerosol-forming substrate preferably includes tobacco. The tobacco containing material preferably contains volatile tobacco flavor compounds, which are released from the aerosol-forming substrate upon heating. The aerosol-forming substrate may include homogenized tobacco material.

Homogenized tobacco material may be formed by agglomerating particulate tobacco. The aerosol-forming substrate may alternatively or additionally include a non-tobacco-containing material. The aerosol-forming substrate may include homogenized plant-based material.

The aerosol-forming substrate may include, for example, one or more of: powder, granules, pellets, shreds, spaghettis, strips, or sheets. The aerosol-forming substrate may contain one or more of: herb leaf, tobacco leaf, fragments of tobacco ribs, reconstituted tobacco, homogenized tobacco, extruded tobacco, and expanded tobacco.

The aerosol-forming substrate may include at least one aerosol former. Suitable aerosol formers include compounds or mixtures of compounds which, in use, facilitate formation of a dense and stable aerosol and which are substantially resistant to thermal degradation at the operating temperature of the shisha device. Suitable aerosol formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly preferred aerosol formers are polyhydric alcohols or mixtures thereof, such as triethylene glycol, 1,3-butanediol and, most preferred, glycerine. The aerosol-forming substrate may include any suitable amount of an aerosol former. For example, the aerosol former content of the substrate may be equal to or greater than 5% on a dry weight basis, and preferably greater than 30% by weight on a dry weight basis. The aerosol former content may be less than about 95% on a dry weight basis. Preferably, the aerosol former content is up to about 55%.

The aerosol-forming substrate preferably includes nicotine and at least one aerosol former. In some embodiments, the aerosol former is glycerine or a mixture of glycerine and one or more other suitable aerosol formers, such as those listed above.

The aerosol-forming substrate may include other additives and ingredients, such as flavorants, sweeteners, etc. In some examples, the aerosol-forming substrate includes one or more sugars in any suitable amount. Preferably, the aerosol-forming substrate includes invert sugar. Invert sugar is a mixture of glucose and fructose obtained by splitting sucrose. Preferably, the aerosol-forming substrate includes from about 1% to about 40% sugar, such as invert sugar, by weight. In some example, one or more sugars may be mixed with a suitable carrier such as cornstarch or maltodextrin.

In some examples, the aerosol-forming substrate includes one or more sensory-enhancing agents. Suitable sensory-enhancing agents include flavorants and sensation agents, such as cooling agents. Suitable flavorants include natural or synthetic menthol, peppermint, spearmint, coffee, tea, spices (such as cinnamon, clove, ginger, or combination thereof), cocoa, vanilla, fruit flavors, chocolate, eucalyptus, geranium, eugenol, agave, juniper, anethole, linalool, and any combination thereof.

In some examples, the aerosol-forming substrate is in the form of a suspension. For example, the aerosol-forming substrate may include molasses. As used herein, "molasses" means an aerosol-forming substrate composition comprising about 20% or more sugar. For example, the molasses may include at least about 25% by weight sugar, such as at least about 35% by weight sugar. Typically, the molasses will contain less than about 60% by weight sugar, such as less than about 50% by weight sugar.

Any suitable amount of aerosol-forming substrate (for example, molasses or tobacco substrate) may be disposed in the cavity. In some preferred embodiments, about 3 g to about 25 g of the aerosol-forming substrate is disposed in the cavity. The cartridge may include at least 6 g, at least 7 g, at least 8 g, or at least 9 g of aerosol-forming substrate. The cartridge may include up to 15 g, up to 12 g; up to 11 g, or up to 10 g of aerosol-forming substrate. Preferably, from about 7 g to about 13 g of aerosol-forming substrate is disposed in the cavity.

The aerosol-forming substrate may be provided on or embedded in a thermally stable carrier. The term "thermally stable" is used here to indicate a material that does not substantially degrade at temperatures to which the substrate is typically heated (for example, about 150° C. to about 300° C.). The carrier may comprise a thin layer on which the substrate deposited on a first major surface, on second major outer surface, or on both the first and second major surfaces. The carrier may be formed of, for example, a paper, or paper-like material, a non-woven carbon fiber mat, a low mass open mesh metallic screen, or a perforated metallic foil or any other thermally stable polymer matrix. Alternatively, the carrier may take the form of powder, granules, pellets, shreds, spaghettis, strips or sheets. The carrier may be a non-woven fabric or fiber bundle into which tobacco components have been incorporated. The non-woven fabric or fiber bundle may comprise, for example, carbon fibers, natural cellulose fibers, or cellulose-derivative fibers.

The body of the cartridge may include one or more walls. In some embodiments, the body includes a top wall, a bottom wall, and a sidewall. The sidewall may be cylindrical or frustoconical, extending from the bottom to the top. The body may include one or more parts. For example, the sidewall and the bottom wall may be an integral single part. The sidewall and the bottom wall may be two parts configured to engage one another in any suitable manner. For example, the sidewall and the bottom wall may be configured to engage one another by threaded engagement or interference fit. The sidewall and the bottom wall may be two parts joined together. For example, the sidewall and the bottom wall may be joined together by welding or by an adhesive. The top wall and sidewall may be a single integral part. The sidewall and the top wall may be two parts configured to engage one another in any suitable manner. For example, sidewall and the top wall may be configured to engage one another by threaded engagement or interference fit. The sidewall and the top wall may be two parts joined together. For example, the sidewall and the top wall may be joined together by welding or by an adhesive. The top wall, sidewall and bottom wall may all be a single integral part. The top wall, the sidewall, and the bottom wall may be three separate parts configured to engage one another in any suitable manner. For example, the top wall, the sidewall, and the bottom wall may be configured to engage by threaded engagement interference fit, welding, or an adhesive.

One or more walls of the body may form a heatable wall or surface. As used here, "heatable wall" and "heatable surface" mean an area of a wall or a surface to which heat may be applied, either directly or indirectly. The heatable wall or surface may function as a heat transfer surface through which heat may be transferred from outside of the body to the cavity or to an internal surface of the cavity.

Preferably, the body of the cartridge has a length (for example, an axial length along a vertical center axis) of about 15 cm or less. In some embodiments, the body has a length of about 10 cm or less. The body may have an inside diameter of about 1 cm or more. The inside diameter of the body may be about 1.75 cm or more. The top wall, bottom wall, or both top and bottom walls may have a diameter of about 1 cm to about 5 cm. The cartridge may have a heatable surface area in the cavity from about 25 $cm^2$ to about 100 $cm^2$, such as from about 70 $cm^2$ to about 100 $cm^2$. The volume of the cavity may be from about 10 $cm^3$ to about 50 $cm^3$; preferably from about 25 $cm^3$ to about 40 $cm^3$. In some embodiments, the body has a length in a range from about 3.5 cm to about 7 cm. The inside diameter of the body may be from about 1.5 cm to about 4 cm. The body may have a heatable surface area in the cavity from about 30 $cm^2$ to about 100 $cm^2$, such as from about 70 $cm^2$ to about 100 $cm^2$. The volume of the cavity may be from about 10 $cm^3$ to about 50 $cm^3$; preferably from about 25 $cm^3$ to about 40 $cm^3$. Preferably, the body is cylindrical or frustoconical.

According to an embodiment of the present disclosure, a cartridge for housing an aerosol-forming substrate has a body comprising a side wall and a bottom wall. A cavity is formed inside the body. One or more of the walls comprise a heat-deformable portion constructed to form an aperture in response to exposure to a temperature at or above a threshold temperature such that the cavity is in fluid communication with an outside of the cartridge body via the formed aperture.

The walls of the body may be made from one or more materials, where either the materials, their construction, or both the material and its construction, are selected such that a heat-deformable portion is formed on one or more walls. The body may include one or more heat-resistant (non-heat-deformable) materials, such as a heat-resistant metal or polymer. For example, the body may comprise any of aluminum, copper, zinc, nickel, silver, any alloys thereof, and combinations thereof. The body may also include one or more heat-deformable materials, such as a heat-deformable polymer or other material capable of changing its shape at a threshold temperature. In some embodiments, the body includes a laminated material or a plurality of layers including two or more materials. In one exemplary embodiment, the body includes a heat-resistant material and a heat-deformable material.

The aperture, including the formed aperture and possible other apertures of the cartridge, may be an opening or ventilation hole through one or more walls of the body. The ventilation holes may be inlets, outlets, or both. The ventilation holes may be disposed at the bottom wall, top wall, sides, or a combination thereof, of the cartridge. In some embodiments, the ventilation holes (for example, one or more inlets and one or more outlets) are formed when the cartridge is heated to allow air to flow through the aerosol-forming substrate when the cartridge is used with a shisha device. In some embodiments, the top wall of the cartridge may define one or more openings to form the one or more inlets of the cartridge. The bottom wall of the cartridge may define one or more openings to form the one or more outlets of the cartridge. Preferably, the one or more inlets and outlets, once formed, are sized and shaped to provide a suitable resistance to draw (RTD) through the cartridge. In some examples, the RTD through the cartridge, from the inlet or inlets to the outlet or outlets, may be from about 10 mm $H_2O$ to about 50 mm $H_2O$, preferably from about 20 mm $H_2O$ to about 40 mm $H_2O$. The RTD of a specimen refers to the static pressure difference between the two ends of the specimen when it is traversed by an airflow under steady conditions in which the volumetric flow is 17.5 milliliters per second at the output end. The RTD of a specimen may be measured using the method set out in ISO Standard 6565:2002.

The one or more apertures or openings on the body, once formed, may cover 5% or greater, 10% or greater, 15% or greater, 20% or greater, or 25% or greater of the area of the wall the openings are on. For example, if the openings are on the top wall, the openings may cover at least 5% of the area of the top wall. The one or more openings on the body may cover 75% or less, 50% or less, 40% or less, or 30% or less of the area of the wall the openings are on.

In some embodiments, the formation of the aperture may be due to a weakening or deformable portion in the material of the wall of the body. The weakening or deformable portion may be provided in any suitable manner as discussed below. The weakening or deformable portion may form an aperture in the wall when exposed to a temperature at or above a threshold temperature. In some embodiments, the threshold temperature is at or below the operating temperature of the shisha device. The operating temperature of the shisha device may include the pre-heating temperature during a pre-heating phase, if any. In a preferred embodiment, the shisha device reaches the threshold temperature during a first stage of heating (for example, pre-heating) of the device.

In some embodiments, at least one of the walls includes a second material that is not deformable at or below the threshold temperature. In some embodiments, the second material is not deformable at the operating temperature of the shisha device. The second material may include an aperture such that the heat-deformable material forms a closure to the aperture in the second material before exposure to a temperature at or above the threshold temperature. Once the heat-deformable material is exposed to the threshold temperature (for example, the cartridge is heated to or above the threshold temperature), the heat-deformable material deforms (for example, changes shape) so that an aperture through the wall of the cartridge is formed. In some embodiments, the wall includes a layer of heat-deformable material adjacent a layer of the second material that is not heat-deformable. The layer of second material has an aperture through the layer, and the layer of heat-deformable material covers the aperture in the second material.

Embodiments that include a first material being the heat-deformable material and a second material that is not heat deformable may have a laminated or layered structure. The first material may be an outer layer, an inner layer, or both an outer layer and an inner layer with a layer of the second material between the outer and inner layers, or a layer between two other layers (for example, between two layers of the second material). The first material may form a continuous layer on the second material, where the second material includes pre-cut holes. In another embodiment, the first material may include a plurality of pieces covering pre-cut holes in the second material. For example, the first material may include an individual piece covering each of a plurality of pre-cut holes in the second material.

Materials suitable for use as the second material that is not heat-deformable include materials that do not deform at or below the threshold temperature. Exemplary materials include metals, such as aluminum, steel, copper, tin foil, and the like, and polymeric materials that have a higher glass transition temperature than the heat-deformable material.

In some embodiments, the heat-deformable portion is formed by a thinner portion in the material. The heat-deformable material may have a first area with a first thickness and a second area with a second thickness, where the second thickness is less than the first thickness such that the area of the second thickness forms the heat-deformable portion.

In some embodiments, the heat-deformable portion is formed by a gas pocket or a plurality of gas pockets in the heat-deformable material of the at least one of the walls. The gas pockets cause the material to be thinner in the area adjacent the gas pocket. When the temperature of the capsule wall material is increased, the heat-deformable material around the gas pockets may deform. Further, the vapor pressure inside the gas pockets may increase, causing the gas pockets to rupture. A plurality of gas pockets may be used to cause a plurality of apertures to form when the heat-deformable material is heated to the threshold temperature.

Preferably the gas inside the gas pockets is inert, does not negatively contribute to the odor of the aerosol, and is not harmful when breathed by a user at the concentration resulting from the use of the cartridge in a shisha device. An example of a suitable gas is $CO_2$.

An example of a material that includes gas pockets surrounded by polymeric walls is a closed cell foam. The material including gas pockets may be combined with a laminated structure, where the wall having the heat-deformable portion also includes a layer of a second material that is not heat deformable and that includes pre-cut holes adjacent the gas pockets.

In some embodiments, the heat-deformable portion includes an open cell foam with a nonporous skin on at least one side of the foam. Examples of techniques for making open cell foams with nonporous skin are described in Tai et al., *Control of Pore Size and Structure of Tissue Engineering Scaffolds Produced by Supercritical Fluid Processing*, European Cells and Materials Vol. 14. 2007 (pages 64-77). Tai et al. exemplify films made from poly-DL-lactide (PDLLA) or poly(lactic-co-glycolic acid) (PLGA) with $CO_2$ gas pushed in using a high-pressure pump and controlling the temperature and pressure during various stages of manufacturing.

The size and shape of the gas pockets may be adjusted by using a surfactant or blowing agent during the manufacturing of the material, and/or during an extrusion process. Examples of techniques for adjusting cell size and shape are described in patent number EP2671911B1 to Meller et al. The size and shape of the gas pockets may be adjusted such that the heat-deformable portion is sufficiently fragile at the threshold temperature.

In some embodiments, the aperture is formed from a slit or cut in the material. For example, the material may have a partially cut hole, where part of the circumference of the hole is cut without removing any material. The edges of the material on opposing sides of the slit or cut may be in contact with one another before the heat-deformable material is heated to the threshold temperature. Once the heat-deformable material is heated to the threshold temperature, the edges of the material may recede due to shrinking, contracting, or curling of the material, causing the aperture to form.

In some embodiments, the heat-deformable portion comprises a region of shape-memory material. Prior to being heated to the threshold temperature, the heat-deformable portion may have a first state. In some embodiments, in the first state, the body is closed. After being heated to the threshold temperature, the heat-deformable portion may have a second state. In some embodiments, in the second state, the body is open. The shape-memory material may return to the first, closed state at or below a recovery temperature. The shape-memory material may return to the first, closed state at or below a recovery temperature at a second threshold temperature.

The shape-memory material may provide a reversible opening of the apertures. The heat-deformable portion may be capable of transitioning from the first state to the second state and from the second state back to the first state, or to a third state that is substantially the same as the first state. For example, the heat-deformable portion may have substantially the same shape in the third state as in the first state such that the third state is also a closed state.

The shape-memory material may be layered with a second material that is not heat deformable. The second material may have pre-cut holes that are covered by the shape-memory material. The shape-memory material may be oriented such that the deformed material in the second state protrudes outwardly from the cartridge. In a layered structure, the shape-memory material may form an outer layer.

Any suitable material may be used to make the heat-deformable portion. For example, the heat-deformable portion may include heat-deformable material comprising a polymer. Examples of suitable polymers include polylactic acid (PLA), polyolefins, polyether ether ketone (PEEK), and polymers used in heat shrinkable and shrink wrap applications. In particular, PLA, polyolefins, and polymers used in heat shrinkable and shrink wrap applications may be suitable in embodiments where a deforming or shrinking behavior of the material is sought. On the other hand, PEEK or a modified PEEK (for example, prepared from sulfonated PEEK ionomers and a high temperature fatty acid salt, such as sodium oleate) may be used when a shape-memory behavior of the material is desired. Examples of suitable non-polymeric shape-memory materials include bimetallic materials, such as an aluminum-stainless steel sheet. An example of a heat-deformable material that includes gas pockets is a closed-cell foam with trapped gas cells surrounded by a polymer.

The threshold temperature may be adjusted by mixing one or more additives into the polymer of the heat-deformable material. For example, poly-D-lactate may be mixed into PLA to increase the threshold temperature by about 50° C.

The heat-deformable material may be selected to have a threshold temperature in a desired range. For example, the heat-deformable material may be selected to have a threshold temperature at or below an operating temperature, such as within a pre-heat temperature, of a shisha device. The threshold temperature may be 400° C. of less, 350° C. or less, 300° C. or less, 250° C. or less, 225° C. or less, 200° C. or less, 175° C. or less, or 150° C. or less. The threshold temperature may be 60° C. or greater, 70° C. or greater, 80° C. or greater, 100° C. or greater, or 125° C. or greater.

In preferred embodiments, the materials of the body do not release noxious, toxic, or hazardous components upon heating. Further, the materials preferably do not release odors or flammable materials upon heating. In some embodiments, the materials of the body, including the heat-deformable material, do not melt at the threshold temperature or at the operating temperature of the shisha device.

If the capsule includes a heat-deformable portion on more than one of the walls, the heat-deformable portions may be similar in material and construction, or may be different from one another. For example, the heat-deformable portions may include any combination of embodiments discussed here.

The heat-deformable portion may be disposed at the bottom wall, the top wall, the side wall, or any combination thereof. In some preferred embodiments, the bottom wall and top wall comprise a heat-deformable portion. In embodiments, where the bottom wall top wall comprise a heat-deformable portion, apertures may be formed at both the bottom and top walls upon heating to the threshold temperature, enabling airflow through the cartridge. The airflow path may be substantially parallel to the vertical center axis of the cartridge.

In some embodiments, the cartridge may further include a lid, seal, or layer covering one or more walls. For example, in embodiments where the heat-deformable portion includes a slit or a cut in the material, the wall may be further covered by a removable cover. The removable cover is preferably sufficient to prevent airflow through the inlets and outlets to prevent leakage of the contents of the cartridge and to extend shelf life. The removable cover may comprise a lid or cap, or a peelable label of sticker, foil, or the like. The label, sticker, or foil may be affixed to the cartridge in any suitable manner, such as with an adhesive, crimping, welding, or otherwise being joined to the container. The seal may comprise a tab that may be grasped to peel or remove the label, sticker, or foil from the cartridge.

In some embodiments the cartridge is a shisha cartridge that may be used with any suitable shisha device. Preferably, the shisha device is configured to sufficiently heat the aerosol-forming substrate in the cartridge to form an aerosol from the aerosol-forming substrate but not to combust the aerosol-forming substrate. For example, the shisha device may be configured to heat the aerosol-forming substrate to a temperature (e.g., the operating temperature) in a range from about 150° C. to about 300° C.; more preferably from about 180° C. to about 250° C. or from about 200° C. to about 230° C. In some embodiments, the shisha device may be configured to heat the cartridge to the threshold temperature or to above the threshold temperature in a first heating stage (for example, a pre-heating stage). The operating temperature of the shisha device may include the pre-heating temperature during the pre-heating phase. The first heating stage may cause the aperture to form in the one or more walls. The shisha device may further be configured to heat the cartridge and the aerosol-forming substrate within it to the desired operating temperature in a second heating stage.

The shisha device may include a receptacle for receiving the cartridge. The shisha device may include a heating element configured to contact or to be in proximity to the body of the cartridge when the cartridge is received in the receptacle. The heating element may form at least part of the receptacle. For example, the heating element may form at least a portion of the surface of the receptacle. The shisha cartridge may be configured to transfer heat from the heating element to the aerosol-forming substrate in the cavity by conduction. In some embodiments, the heating element includes an electric heating element. In some embodiments, the heating element includes a resistive heating component. For example, the heating element may include one or more resistive wires or other resistive elements. The resistive wires may be in contact with a thermally conductive material to distribute heat produced over a broader area. Examples of suitable conductive materials include aluminum, copper, zinc, nickel, silver, and combinations thereof. The heating element may form at least a portion of the surface of the receptacle.

The shisha device may include control electronics operably coupled to the heating element. The control electronics may be configured to control heating of the heating element. The control electronics may be configured to control the temperature to which the aerosol-forming substrate in the cartridge is heated. The control electronics may be provided in any suitable form and may, for example, include a controller or a memory and a controller. The controller may include one or more of an Application Specific Integrated Circuit (ASIC) state machine, a digital signal processor, a gate array, a microprocessor, or equivalent discrete or integrated logic circuitry. Control electronics may include memory that contains instructions that cause one or more components of the circuitry to carry out a function or embodiment of the control electronics. Functions attributable to control electronics in this disclosure may be embodied as one or more of software, firmware, and hardware.

The electronic circuitry may include a microprocessor, which may be a programmable microprocessor. The electronic circuitry may be configured to regulate a supply of power. The power may be supplied to the heater element in the form of pulses of electrical current.

In some examples, the control electronics may be configured to monitor the electrical resistance of the heating element and to control the supply of power to the heating element depending on the electrical resistance of the heating element. In this manner, the control electronics may regulate the temperature of the resistive element.

The shisha device may include a temperature sensor, such as a thermocouple. The temperature sensor may be operably coupled to the control electronics to control the temperature of the heating element. The temperature sensor may be positioned in any suitable location. For example, the temperature sensor may be configured to insert into the cartridge when received within the receptacle to monitor the temperature of the aerosol-forming substrate being heated. In addition or alternatively, the temperature sensor may be in contact with the heating element. In addition or alternatively, the temperature sensor may be positioned to detect temperature at an aerosol outlet of the shisha device or a portion thereof. The sensor may transmit signals regarding the sensed temperature to the control electronics. The control electronics may adjust heating of the heating elements in response to the signal to achieve a suitable temperature at the sensor.

In some embodiments, the aerosol-generating device may have a piercing element configured to create one or more openings in the capsule. For example, the aerosol-generating device may have a piercing element configured to create one or more openings at the bottom of the capsule while the top, side, or both top and side of the capsule comprise heat-deformable material. In another example, the aerosol-generating device may have a piercing element configured to create one or more openings at the top of the capsule while the bottom, side, or both bottom and side of the capsule comprise heat-deformable material. The piercing element may comprise one or more spikes, blades, or needles. The piercing element may be configured to perforate one or more walls of the capsule as the capsule is placed into the aerosol-generating device. The aerosol-generating device may be a shisha device. The shisha device may comprise a receptacle. The piercing element may be disposed within the receptacle. For example, the piercing element may be placed at the bottom, top, or both bottom and top of the receptacle.

The shisha device may further include a sensor configured to detect the presence of a capsule in the receptacle. In particular, the shisha device may include a sensor configured to detect the presence of a capsule and whether the capsule has apertures or if the apertures are to be created by heating the capsule. The shisha cartridge may be configured to initiate the first phase of heating when a capsule without apertures is detected.

The control electronics may be operably coupled to a power supply. The shisha device may include any suitable power supply. For example, a power supply of a shisha device may be a battery or set of batteries. The batteries of the power supply may be rechargeable, removable and replaceable, or rechargeable and removable and replaceable. Any suitable battery may be used. For example, heavy duty type or standard batteries existing in the market, such as used for industrial heavy duty electrical power-tools. Alternatively, the power supply may be any type of electric power supply including a super or hyper-capacitor. Alternatively, the assembly may be connected to an external electrical power source, and electrically and electronically designed for such purpose. Regardless of the type of power supply employed, the power supply preferably provides sufficient energy for the normal functioning of the assembly for at least one shisha session until aerosol is depleted from the aerosol-forming substrate in the cartridge before being recharged or needing to connect to an external electrical power source. Preferably, the power supply provides sufficient energy for the normal functioning of the assembly for at least about 70 minutes of continuous operation of the device, before being recharged or needing to connect to an external electrical power source.

In one example, a shisha device includes an aerosol-generating element that includes a cartridge receptacle, a heating element, an aerosol outlet, and a fresh air inlet. The cartridge receptacle is configured to receive a cartridge according to the present disclosure containing the aerosol-forming substrate. The heating element may define at least part of a surface of the receptacle.

The shisha device includes a fresh air inlet channel in fluid connection with the receptacle. In use, when the substrate inside the cartridge is heated, aerosol former components in the substrate vaporize. Air flowing from the fresh air inlet channel through the cartridge becomes entrained with aerosol generated from the aerosol former components in the cartridge.

Some electrically heated shisha devices employ preheated air and typically employ an airflow path such that the air travels in the vicinity of the heat source upon puffing. Further, some electrically heated shisha devices employ elements that increase radiation heat transfer by increasing the heated surface area.

The fresh air inlet channel may include one or more apertures through the cartridge receptacle such that fresh air from outside the shisha device may flow through the channel and into the cartridge receptacle through the one or more apertures. If a channel includes more than one aperture, the channel may include a manifold to direct air flowing through the channel to each aperture. Preferably, the shisha device includes two or more fresh air inlet channels.

As described above, the cartridge includes one or more openings (such as inlets or outlets) formed in the body, allowing air to flow through the cartridge. If the receptacle includes one or more inlet apertures, at least some of the inlets in the cartridge may align with the apertures in the top of the receptacle. The cartridge may include an alignment feature configured to mate with a complementary alignment feature of the receptacle to align the inlets of the cartridge with the apertures of the receptacle when the cartridge is inserted into the receptacle.

Air that enters the cartridge may flow across or through, or both across and through the aerosol-forming substrate, entraining aerosol, and exiting the cartridge and receptacle via an aerosol outlet. From the aerosol outlet, the air carrying the aerosol enters a vessel of the shisha device.

The shisha device may include any suitable vessel defining an interior volume configured to contain a liquid and defining an outlet in the headspace above a liquid fill level. The vessel may include an optically transparent or opaque housing to allow a consumer to observe contents contained in the vessel. The vessel may include a liquid fill demarcation, such as a liquid fill line. The vessel housing may be formed of any suitable material. For example, the vessel housing may include glass or suitable rigid plastic material. Preferably, the vessel is removable from a portion of the shisha assembly comprising the aerosol-generation element to allow a consumer to fill, empty or clean the vessel.

The vessel may be filled to a liquid fill level by a consumer. The liquid preferably includes water, which may optionally be infused with one or more colorants, flavorants, or colorants and flavorants. For example, the water may be infused with one or both of botanical and herbal infusions.

Aerosol entrained in air exiting the aerosol outlet of the receptacle may travel through a conduit positioned in the vessel. The conduit may be coupled to the aerosol outlet of the aerosol-generating element and may have an opening below the liquid fill level of the vessel, such that aerosol flowing through the vessel flows through the opening of the conduit, then through the liquid, into headspace of the vessel and exits through a headspace outlet, for delivery to a consumer.

The headspace outlet may be coupled to a hose comprising a mouthpiece for delivering the aerosol to a consumer. The mouthpiece may include an activation element, such as a switch activatable by a user, a puff sensor arranged to detect a user puffing on the mouthpiece, or both a switch activatable by the user and a puff sensor. The activation element is operably coupled to the control electronics of the shisha device. The activation element may be wirelessly coupled to the control electronics. Activation of the activation element may cause the control electronics to activate the heating element, rather than constantly supplying energy to the heating element. Accordingly, the use of an activation element may serve to save energy relative to devices not employing such elements to provide on-demand heating rather than constant heating.

For purposes of example, one method for using a shisha device as described herein is provided below in chronological order. The vessel may be detached from other components of the shisha device and filled with water. One or more of natural fruit juices, botanicals, and herbal infusions may be added to the water for flavoring. The amount of liquid added should cover a portion of the conduit but should not exceed a fill level mark that may optionally exist on the vessel. The vessel is then reassembled to the shisha device. The cartridge may be prepared by removing any removable layer (if present). A portion of the aerosol-generating element may be removed or opened to allow the cartridge to be inserted into the receptacle. The aerosol-generating element is then reassembled or closed. The device may then be turned on. Turning on the device may initiate a heating profile of a heating element, to heat the heat-deformable portion of the cartridge and to form or expose apertures in the wall of the cartridge, and then to heat the aerosol-forming substrate to a temperature at or above a vaporization temperature but below a combustion temperature of the aerosol-forming substrate. The aerosol forming compounds of the aerosol-forming substrate vaporize, generating an aerosol. The user may puff on the mouthpiece as desired. The user may continue using the device as long as desired or until no more aerosol is visible or being delivered. In some embodiments, the device may be arranged to automatically shut off when the cartridge or a compartment of the cartridge is depleted of usable aerosol-forming substrate. In some embodiments, the consumer may refill the device with a fresh cartridge after, for example, receiving the cue from the device that the aerosol-forming substrate in the cartridge is depleted or nearly depleted. The shisha device may be turned off at any time by a consumer by, for example, switching off the device.

The shisha device may have any suitable air management. In one example, puffing action from the user will create a suction effect causing a low pressure inside the device which will cause external air to flow through an air inlet of the device, into the fresh air inlet channel, and into the receptacle. The air may then flow through the cartridge in the receptacle and become entrained with aerosol produced from the aerosol-forming substrate. The air with entrained aerosol then exits the aerosol outlet of the receptacle, flows through the conduit to the liquid inside the vessel. The aerosol will then bubble out of the liquid and into head space in the vessel above the level of the liquid, out the headspace outlet, and through the hose and mouthpiece for delivery to the consumer. The flow of external air and the flow of the aerosol inside the shisha device may be driven by the action of puffing from the user.

In some embodiments, the method comprises placing a cartridge in the receptacle of a shisha device. The cartridge may comprise a body with a side wall and a bottom wall, and a cavity inside the body. An aerosol-generating substrate may be disposed in the cavity. One or more of the walls of the body may comprise a heat deformable portion configured to form an aperture in response to exposure of the heat-deformable portion to a temperature above a threshold temperature. The cavity may be in fluid communication with an outside of the cartridge body via the formed aperture. The shisha device may include a receptacle for receiving the cartridge, a heating element for heating the cartridge, an aerosol conduit for conveying aerosol from the receptacle to a vessel having a liquid fill level and defining a head space above the liquid fill level, and an outlet in fluid communication with the head space. The heating element may be activated to heat the heat-deformable portion above the threshold temperature. Heating with the heating element may cause an aperture to form in the heat-deformable portion and the cavity to be in fluid communication with the aerosol conduit. In some embodiments, the aerosol-forming substrate comprises tobacco. In some embodiments, the aerosol-forming substrate comprises a shisha substrate, such as hookah tobacco.

Reference will now be made to the drawings, which depict one or more embodiments described in this disclosure. However, it will be understood that other embodiments not depicted in the drawings fall within the scope and spirit of this disclosure. Like numbers used in the figures refer to like components. The use of different numbers to refer to components in different figures is not intended to indicate that the different numbered components cannot be the same or similar to other numbered components. The figures are presented for purposes of illustration and not limitation. Schematic drawings presented in the figures are not necessarily to scale.

Figure 1:
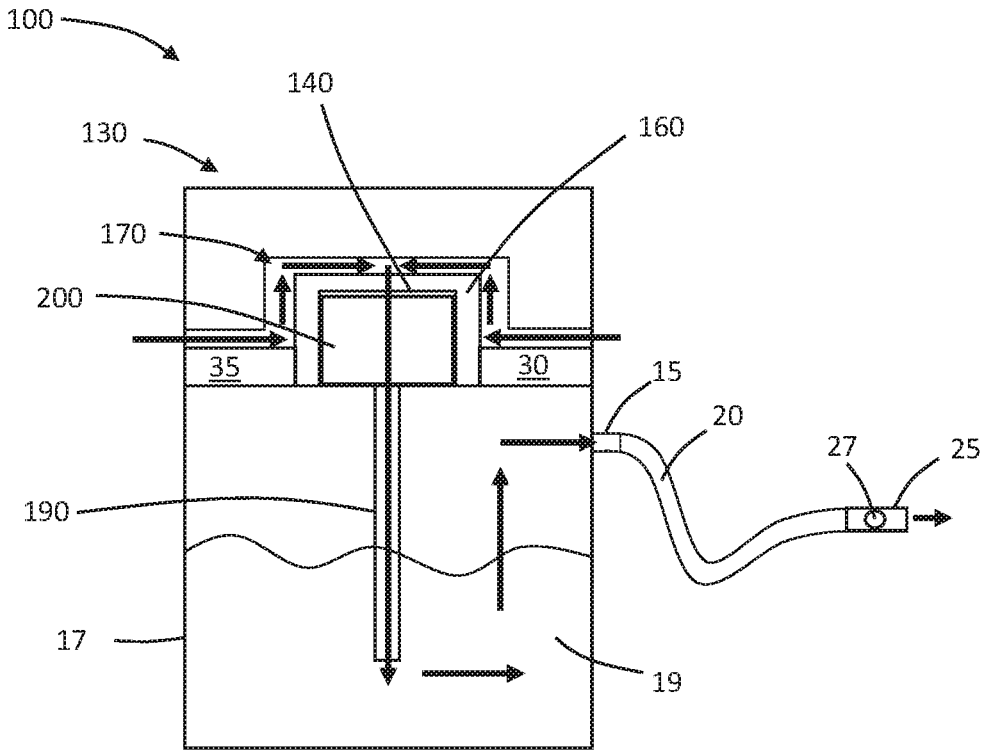
FIG. 1 is a schematic view of a shisha device.

FIG. 1 is a schematic sectional view of an example of a shisha device 100. The device 100 includes a vessel 17 defining an interior volume configured to contain liquid 19 and defining a headspace outlet 15 above a fill level for the liquid 19. The liquid 19 preferably includes water, which may optionally be infused with one or more colorants, one or more flavorants, or one or more colorants and one or more flavorants. For example, the water may be infused with one or both of botanical infusions and herbal infusions.

The device 100 also includes an aerosol-generating element 130. The aerosol-generating element 130 includes a receptacle 140 configured to receive a cartridge 200 comprising an aerosol-forming substrate. The aerosol-generating element 130 may also include a heating element 160. The heating element 160 may form at least one surface of the receptacle 140. In the depicted embodiment, the heating element 160 defines the side surfaces and the top surface of the receptacle 140. The heating element 160 is constructed to heat the cartridge 200. The aerosol-generating element 130 also includes a fresh air inlet channel 170 that draws fresh air into the device 100. In some embodiments, portion of the fresh air inlet channel 170 is formed by the heating element 160 to heat the air before the air enters the receptacle 140. The pre-heated air then enters the cartridge 200, which is also heated by heating element 160, to carry aerosol generated by the aerosol former and the aerosol-forming substrate. The air exits an outlet of the aerosol-generating element 130 and enters a conduit 190.

The conduit 190 carries the air and aerosol into the vessel 17 below the level of the liquid 19. The air and aerosol may bubble through the liquid 19 and exit the headspace outlet 15 of the vessel 17. A hose 20 may be attached to the headspace outlet 15 to carry the aerosol to the mouth of a user. A mouthpiece 25 may be attached to, or form a part of, the hose 20.

An exemplary airflow path of the device, in use, is depicted by thick arrows in FIG. 1.

The mouthpiece 25 may include an activation element 27. The activation element 27 may be a switch, button or the like, or may be a puff sensor or the like. The activation element 27 may be placed at any other suitable location of the device 100. The activation element 27 may be in wireless communication with the control electronics 30 to place the device 100 in condition for use or to cause control electronics to activate the heating element 160; for example, by causing power supply 35 to energize the heating element 160.

The control electronics 30 and power supply 35 may be located in any suitable position of the aerosol-generating element 130, including locations other than the bottom portion of the element 130 as depicted in FIG. 1.

Figure 2A:
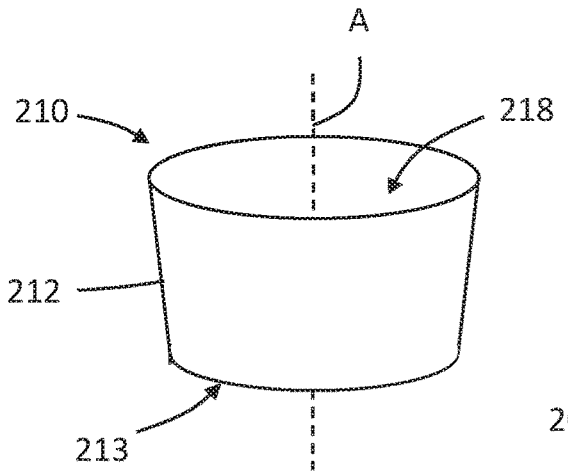
FIGS. 2A and 2B are schematic top and bottom perspective views, respectively, of the body of a shisha cartridge for use in the shisha device of FIG. 1 according to an embodiment.
Figure 2B:
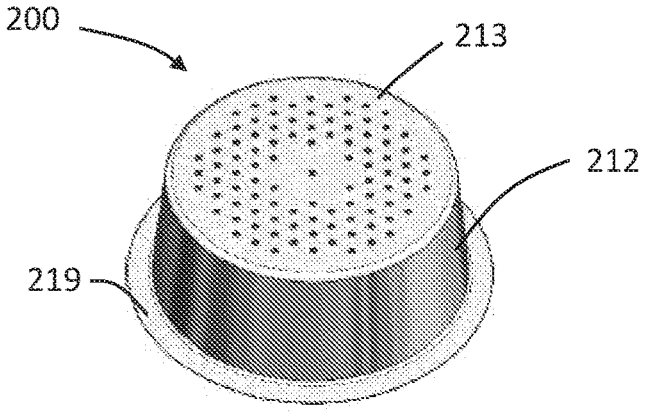

Referring now to FIGS. 2A and 2B, various embodiments of the body 210 of the cartridge 200 are shown. The body 210 may include a side wall 212, a top wall 215, and a bottom wall 213 defining a cavity 218. The side wall 212 may be cylindrical or frustoconical, as shown. FIG. 2A shows the body 210 without a top, showing the cavity 218 inside the body. The body 210 may define a center axis A extending through the body 210. The top may comprise a flange 219 that extends from the sidewall 212 as shown in FIG. 2B. The flange 219 may rest on shoulder of a receptacle of a shisha device so that cartridge 200 may be readily removed from the receptacle after use by grasping the flange.

Figure 3A:
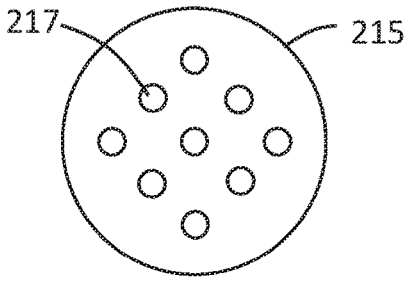
FIGS. 3A and 3B are schematic top and bottom views of a cartridge.
Figure 3B:
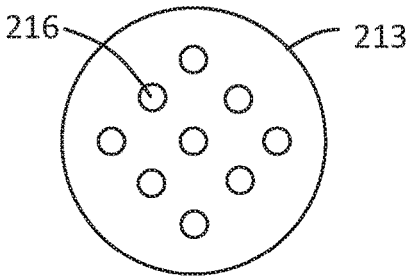

Referring now to FIGS. 3A and 3B, generally, the top 215 and bottom 213 of the body may have a plurality of apertures 217, 216 to allow airflow through the cartridge when the cartridge is in use. The apertures 216, 217 of the top 215 and bottom 213 may be aligned with each other. The cartridge 200 may also or alternatively include apertures along the sidewall 212.

According to an embodiment of the present disclosure, the apertures 216, 217 are initially closed by a heat-deformable portion 317. The heat-deformable portion may be provided in the top 215, the bottom 213, or the sidewall 212, or a combination thereof, such as both the top 215 and the bottom 213. Although FIGS. 4A-10B depict a bottom 213, the embodiments can be equally applied to the top 215 or the side wall 212.

Figure 4A:
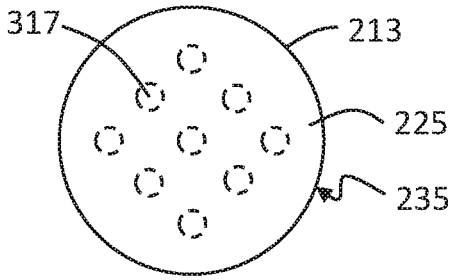
FIGS. 4A and 4B are schematic plan views of a bottom wall of cartridge according to an embodiment.
Figure 4B:
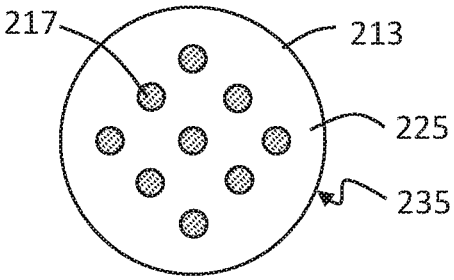

FIGS. 4A and 4B respectively show the bottom 213 of the cartridge before exposure to a temperature at or above the threshold temperature (FIG. 4A, closed state), and after exposure to a temperature at or above the threshold temperature (FIG. 4B, open state). The wall (for example, bottom 213) has a first surface 225 and an opposing second surface 235. In some embodiments, the first surface 225 is an outer surface and the second surface 235 is an inner surface. In the closed state, the wall includes one or more heat-deformable portions 317. In the open state, after exposure to a temperature at or above the threshold temperature, the wall includes apertures 217 formed from or at the heat-deformable portions 317. Cross-sectional views of various exemplary embodiments of the heat-deformable portions 317 are shown in FIGS. 5A-9B.

Figure 5A:
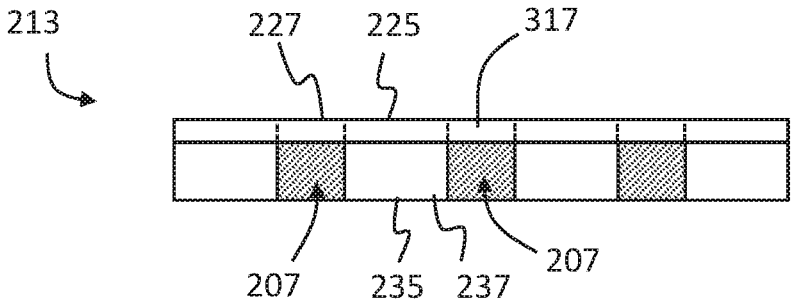
FIGS. 5A and 5B are schematic cross-sectional views of a bottom wall of cartridge according to an embodiment.
Figure 5B:
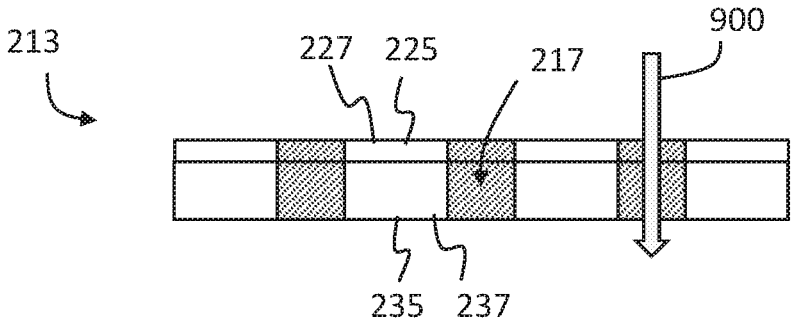

FIGS. 5A and 5B show a cross section of the bottom 213 of the cartridge formed from a layer of a first material 227 adjacent a layer of a second material 237. The first material 227 is a heat-deformable material, and the second material 237 is not heat-deformable. The layer of second material 237 may have pre-formed apertures 207 extending through the layer. Prior to exposure to a temperature at or above a first threshold temperature (FIG. 5A, closed state), the layer of first material 227 forms heat-deformable portions 317 that cover the pre-formed apertures 207 of the layer of second material 237. When the cartridge wall (for example, bottom 213) is exposed to a temperature at or above the first threshold temperature, the heat-deformable portions 317 deform, causing apertures 217 to form. The apertures 217 extend through the two-layered wall, allowing airflow 900 through the wall (open state, FIG. 5B).

Figure 6A:
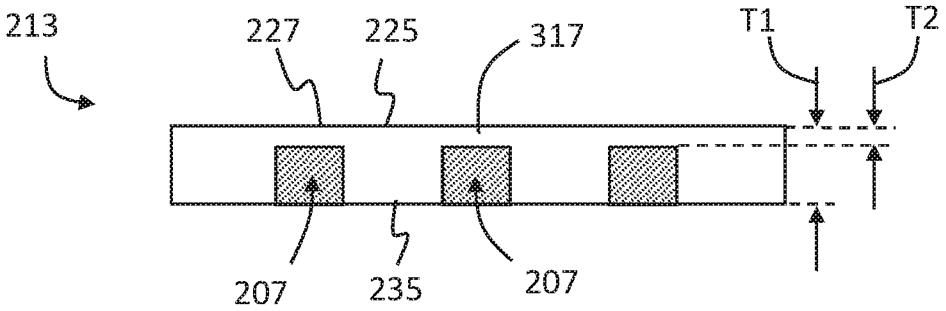
FIGS. 6A and 6B are schematic cross-sectional views of a bottom wall of cartridge according to an embodiment.
Figure 6B:
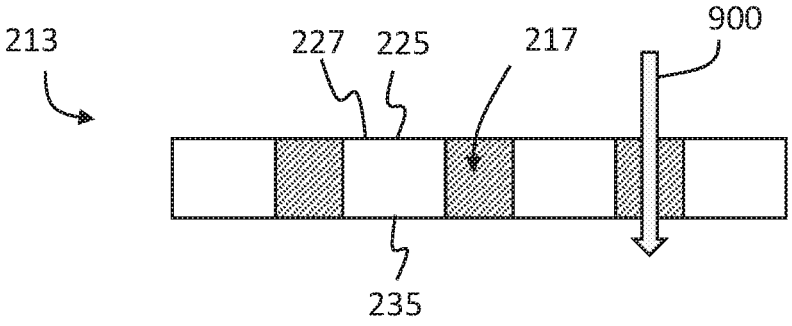

In another embodiment shown in FIGS. 6A and 6B, the bottom 213 of the cartridge is made from a single layer that has thinner portions or partial apertures 207. In the closed state (FIG. 6A), the bottom 213 has areas of first thickness T1, and in the areas of the partial apertures 207, has heat-deformable portions 317 with a second thickness T2. The second thickness T2 is smaller than the first thickness T1. When the cartridge wall (for example, bottom 213) is exposed to a temperature at or above the first threshold temperature, the material at the heat-deformable portions 317 deforms, causing apertures 217 to form. For example, when the cartridge wall (for example, bottom 213) is exposed to a temperature at or above the threshold temperature, the material at the heat-deformable portions 317 ruptures, causing apertures 217 to form. The apertures 217 extend through the wall, allowing airflow 900 through the wall (open state, FIG. 6B).

Figure 7A:
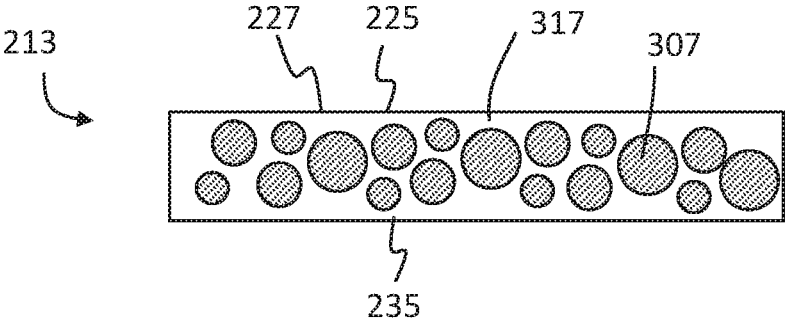
FIGS. 7A and 7B are schematic cross-sectional views of a bottom wall of cartridge according to an embodiment.
Figure 7B:
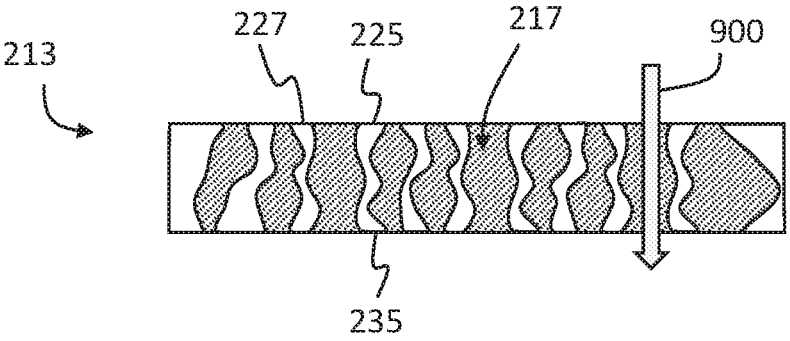

FIGS. 7A and 7B show a cartridge wall (for example, bottom 213), where heat-deformable portions 317 are formed by gas pockets 307. The gas pockets 307 may be provided, in some embodiments, by a porous closed cell material. In the closed state (FIG. 7A), the gas pockets 307 may cause the material 227 to be thinner in the area adjacent the gas pocket. When the cartridge wall (for example, bottom 213) is exposed to a temperature at or above the threshold temperature, the gas pockets 307 may rupture and/or the material at the heat-deformable portions 317 may deform, causing apertures 217 to form. The apertures 217 extend through the wall, allowing airflow 900 through the wall (open state FIG. 7B).

Figure 8A:
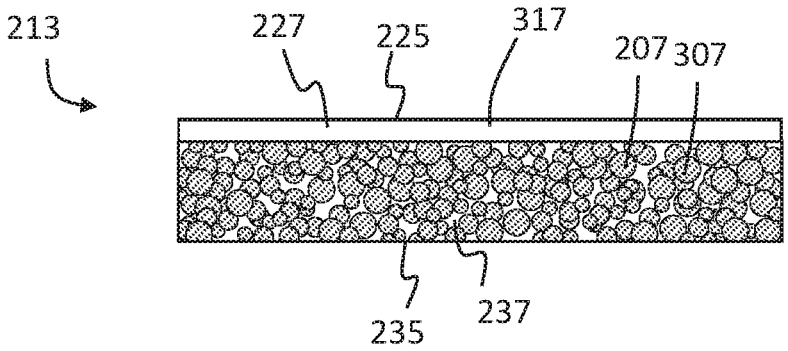
FIGS. 8A and 8B are schematic cross-sectional views of a bottom wall of cartridge according to an embodiment.
Figure 8B:
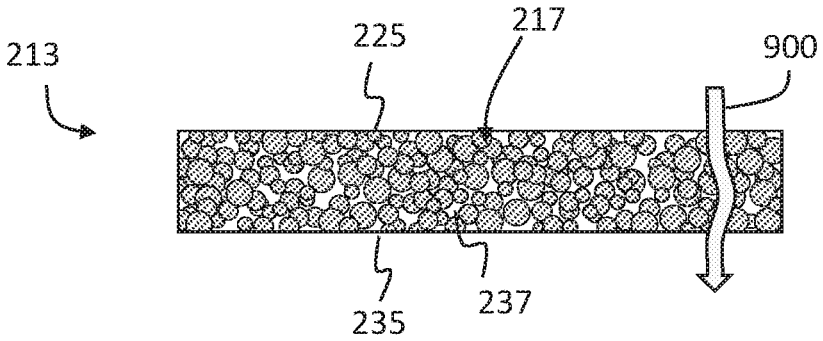

FIGS. 8A and 8B show a cartridge wall (for example, bottom 213) formed from a layer of a first material 227 adjacent a layer of a second material 237. The first material 227 is a heat-deformable material. The second material 237 may be an open cell foam comprising gas pockets 307. At least some of the gas pockets 307 are connected and form apertures 207 extending through the layer. Prior to exposure to a temperature at or above a threshold temperature (FIG. 8A, closed state), the layer of first material 227 forms heat-deformable portions 317 that cover the pre-formed apertures 207 of the layer of second material 237. When the cartridge wall (for example, bottom 213) is exposed to a temperature at or above the threshold temperature, the heat-deformable portions 317 deform, causing apertures 217 to form. The apertures 217 extend through the two-layered wall, allowing airflow 900 through the wall (open state, FIG. 8B).

Figure 9A:
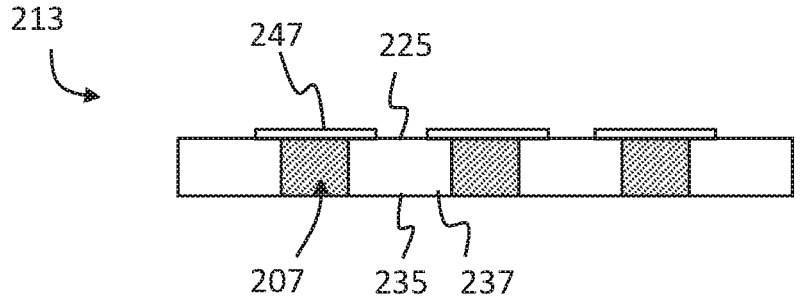
FIGS. 9A and 9B are schematic cross-sectional views of a bottom wall of cartridge according to an embodiment.
Figure 9B:
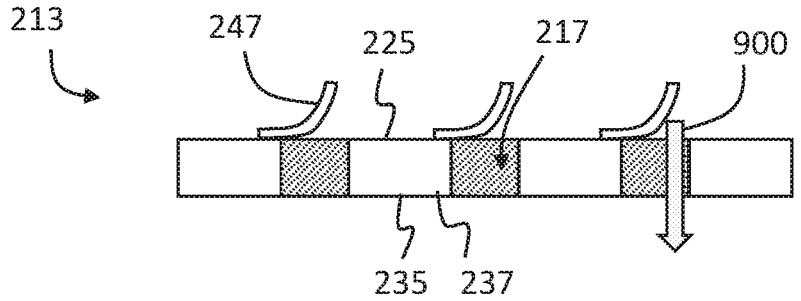

The pre-formed apertures 207 in the wall may be covered by a shape-memory material 247, as shown in FIGS. 9A and 9B. The shape-memory material 247 may include multiple pieces of material, as shown, for example, each covering a pre-formed aperture 207, or in some embodiments, the shape-memory material may be provided as a single sheet covering a plurality of the pre-formed apertures 207 (closed position, FIG. 9A). When the cartridge wall (for example, bottom 213) is exposed to a temperature at or above the threshold temperature, the shape-memory material 247 may change shape (for example, contract, bend or, as shown in FIG. 9B, curl), causing apertures 217 to form. The apertures 217 extend through the wall, allowing airflow 900 through the wall (open position, FIG. 9B).

Figure 10A:
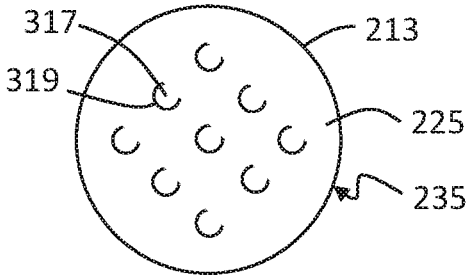
FIGS. 10A and 10B are schematic plan views of a bottom wall of cartridge according to an embodiment.
Figure 10B:
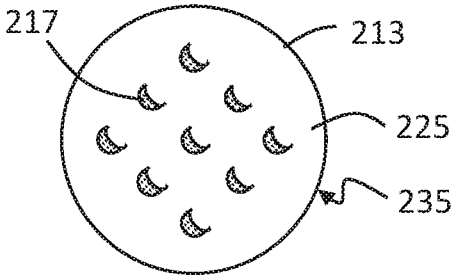

FIG. 10A shows an embodiment where the bottom 213 of the cartridge before exposure to a temperature at or above the threshold temperature has partially cut holes 319 or slits, which form the heat-deformable portions 317. For example, the material may have a partially cut hole, where part of the circumference of the hole is cut or perforated without removing any material. The edges of the material on opposing sides of the slit or cut may be in contact with one another before the heat-deformable material is heated to the threshold temperature so that the wall is in a closed state (FIG. 10A). When the cartridge wall (for example, bottom 213) is exposed to a temperature at or above the threshold temperature, the heat-deformable material of the wall deforms (for example, shrinks or curls), and the apertures 217 are formed adjacent the partially cut holes 319 or slits in the material, as shown in FIG. 10B. In some embodiments, the heat-deformable material may be shape-memory material such that the deformation is substantially reversible. The cartridge wall (for example, bottom 213) may be formed of a single layer, or may include more than one layer. The cartridge wall (for example, bottom 213) may optionally be covered by a removable film or sticker to prevent leaks through the partially cut holes or slits.

Thus, cartridges for aerosol-generating devices, such as shisha devices, are described. Various modifications and variations of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are apparent to those skilled in the mechanical arts, chemical arts, and aerosol-generating article manufacturing or related fields are intended to be within the scope of the following claims.

The invention claimed is:

1. A shisha cartridge for housing an aerosol-forming shisha substrate for use in a shisha device, the shisha cartridge comprising:

a body comprising a side wall and a bottom wall; and a cavity inside the body;

one or more of the walls comprising a heat-deformable portion configured to form an aperture in response to exposure above a threshold temperature, wherein the cavity is in fluid communication with an outside of the cartridge body via the formed aperture.

2. A shisha cartridge according to claim 1, wherein at least one of the walls comprises a second material not heat-deformable at or below the threshold temperature, the second material comprising an aperture, and wherein the heat-deformable material forms a closure to the aperture in the second material before exposure to the threshold temperature.

3. A shisha cartridge according to claim 1, wherein at least one of the walls comprises heat-deformable material having a first area with a first thickness and a second area with a second thickness, wherein the area of the second thickness forms the heat-deformable portion.

4. A shisha cartridge according to claim 1, wherein at least one of the walls comprises heat-deformable material comprising a gas pocket, wherein the gas pocket forms the heat-deformable portion.

5. A shisha cartridge according to claim 1, wherein at least one of the walls comprises heat-deformable material adjacent a slit or a cut, wherein the heat-deformable material adjacent the slit or cut forms the heat-deformable portion.

6. A shisha cartridge according to claim 1, wherein the heat-deformable portion comprises a region of shape-memory material.

7. A shisha cartridge according to claim 6, wherein the heat-deformable portion has a first state below the threshold temperature and a second state above the threshold temperature, wherein in the first state the body is closed and wherein in the second state the body is open, and wherein the heat-deformable portion is capable of transitioning from the first state to the second state and from the second state to the first state.

8. A shisha cartridge according to claim 1, wherein the heat-deformable portion comprises heat-deformable material comprising a polymer.

9. A shisha cartridge according to claim 1, wherein the threshold temperature is 250° C. or less.

10. A shisha cartridge according to claim 1, wherein the threshold temperature is at an operating temperature of a shisha device.

11. A shisha cartridge according to claim 1, wherein the heat-deformable portion is disposed at the bottom wall, at the side wall, at a top wall, or a combination thereof.

12. A shisha cartridge according to claim 1, wherein the walls comprise metal adjacent the heat-deformable portion.

13. A shisha cartridge according to claim 1 comprising an aerosol-forming shisha substrate disposed in the cavity.

14. A shisha system comprising:

a shisha cartridge according to claim 1 with an aerosol-forming shisha substrate disposed in the cartridge; and a shisha device comprising:

a receptacle for receiving the cartridge;

a heating element for heating the aerosol-forming shisha substrate when the cartridge is received in the receptacle of the shisha device;

a vessel having a liquid fill level and defining a head space above the liquid fill level;

an aerosol conduit for conveying aerosol from the receptacle to the vessel; and an outlet in fluid communication with the head space.

15. A method of using the shisha system of claim 14, the method comprising:

placing the shisha cartridge in the receptacle; and activating the heating element to heat the heat-deformable portion above the threshold temperature causing an aperture to form in the heat-deformable portion and the cavity to be in fluid communication with the aerosol conduit.

* * * * *